US008475662B2

(12) United States Patent
Domke et al.

(10) Patent No.: US 8,475,662 B2
(45) Date of Patent: Jul. 2, 2013

(54) MODIFIED HIMS PROCESS

(75) Inventors: Imme Domke, Mannheim (DE); Reinhold Rieger, Offstein (DE); Alexej Michailovski, Ludwigshafen (DE); Christian Bittner, Bensheim (DE)

(73) Assignees: BASF SE, Ludwigshafen (DE); BASF Corporation, Florham Park, NJ (US); Siemens Aktiengesellschaft, Munich (DE)

( * ) Notice: Subject to any disclaimer, the term of this patent is extended or adjusted under 35 U.S.C. 154(b) by 411 days.

(21) Appl. No.: 12/951,586

(22) Filed: Nov. 22, 2010

(65) Prior Publication Data

US 2011/0127201 A1 Jun. 2, 2011

Related U.S. Application Data

(60) Provisional application No. 61/264,846, filed on Nov. 30, 2009.

(51) Int. Cl.
*B03C 1/015* (2006.01)
*B03C 1/02* (2006.01)

(52) U.S. Cl.
USPC ..... 210/695; 210/679; 210/714; 210/222; 209/5; 209/8; 209/9; 209/39; 209/214

(58) Field of Classification Search
USPC ..... 210/679, 695, 714, 222; 209/5, 8, 209/9, 39, 214
See application file for complete search history.

(56) References Cited

U.S. PATENT DOCUMENTS 4,834,898 A 5/1989 Hwang
8,318,025 B2 * 11/2012 Domke et al. ..... 210/695
8,329,039 B2 * 12/2012 Domke et al. ..... 210/695

FOREIGN PATENT DOCUMENTS

WO WO 02066168 A1 * 8/2002

OTHER PUBLICATIONS

Gray, S. R. et al., "Recovery of Fine Gold Particles by Flocculation With Hydrophobic Magnetite", Extractive Metallurgy Conference, Total 5 Pages, (Oct. 2-4, 1991).*

* cited by examiner

*Primary Examiner* — David A Reifsnyder
(74) *Attorney, Agent, or Firm* — Melanie L. Brown

(57) ABSTRACT

The present invention relates to a process for separating at least one first material from a mixture comprising this at least one first material and at least one second material using magnetic particles with which the at least one first material agglomerates.

12 Claims, No Drawings

MODIFIED HIMS PROCESS

This patent application claims priority to pending U.S. provisional patent application 61/264,846 filed Nov. 30, 2009 incorporated herein in its entirety by reference.

DESCRIPTION

The present invention relates to a process for separating at least one first material from a mixture comprising this at least one first material and at least one second material, which comprises at least the following steps (A) contacting of the mixture comprising at least one first material and at least one second material with at least one magnetic particle in the presence of at least one dispersion medium, so that the at least one first material and the magnetic particle aggregate, (B) if appropriate addition of further dispersion medium to the dispersion obtained in step (A), (C) separation of the agglomerate of at least one first material and at least one magnetic particle from the dispersion from step (A) or (B) in an apparatus which in its interior has a separation space having at least one magnetizable device, preferably in the longitudinal direction, by application of an external magnetic field so that the agglomerate adheres to the magnetizable device, (D) flushing and/or blowing-out of the separation space of step (C) while the external magnetic field is applied in order to be able to carry out a low-contamination change of the dispersion medium, (E) removal of the agglomerate from the magnetizable device by removal of the magnetic field and flushing with a second or modified dispersion medium in which the agglomerate is dissociated in order to obtain a dispersion which comprises the at least one first material and the at least one magnetic particle separately from one another, (F) treatment of the dispersion from step (E) in an apparatus which in its interior has a separation space having at least one magnetizable device, preferably in the longitudinal direction, by application of an external magnetic field so that the at least one magnetic particle adheres to the magnetizable devices and the at least one first material remains in dispersion, (G) flushing and/or blowing-out of the separation space of step (F) while an external magnetic field is applied in order to be able to carry out a low-contamination change of the dispersion medium, (H) removal of the at least one magnetic particle from the magnetizable device by removal of the magnetic field.

In particular, the present invention relates to a process for the enrichment of ores in the presence of the gangue.

Processes for separating ores from mixtures comprising them are already known from the prior art.

WO 02/0066168 A1 relates to a process for separating ores from mixtures comprising them, in which suspensions or slurries of these mixtures are treated with particles which are magnetic and/or can float in aqueous solutions. After addition of the magnetic and/or floatable particles, a magnetic field is applied so that the agglomerates are separated off from the mixture. However, the degree of attachment of the magnetic particles to the ores and the strength of the bond are not sufficient to carry out the process with a sufficiently high yield and effectiveness.

U.S. Pat. No. 4,834,898 discloses a process for separating off nonmagnetic materials by bringing them into contact with magnetic reagents which are enveloped in two layers of surface-active substances. U.S. Pat. No. 4,834,898 further discloses that the surface charge of the nonmagnetic particles which are to be separated off can be influenced by various types and concentrations of electrolyte reagents. For example, the surface charge is altered by addition of multivalent anions, for example tripolyphosphate ions.

S. R. Gray, D. Landberg, N. B. Gray, Extractive Metallurgy Conference, Perth, Oct. 2-4, 1991, pages 223-226, discloses a process for recovering small gold particles by bringing the particles into contact with magnetite. Before the contacting, the gold particles are treated with potassium amyixanthogenate. A process for separating off the gold particles from at least one hydrophilic material is not disclosed in this document.

WO 2009/030669 A2 discloses a process for separating ores from mixtures of these with the gangue by means of magnetic particles, in which the ore is firstly hydrophobicized by means of a suitable substance so that the hydrophobicized ore and the magnetic particle agglomerate and can be separated off.

WO 2009/065802 A2 discloses a similar process for separating an ore from the gangue by means of magnetic particles, in which the agglomeration of magnetic particle and ore is based on different surface charges. Both processes are in need of improvement in terms of their efficiency.

The processes known from the prior art are, for example, carried out by means of magnetic rotating drums. As a result of the magnetic attractive force between magnetic drum and the magnetic constituents, the latter adhere to the drum and are separated off from the aqueous dispersion to be separated by the rotational motion. The nonmagnetic constituents are not fixed on the drum because of the lack of attractive force and they remain in the dispersion. The magnetic constituents can be detached from the magnetic drum by using, for example, mechanical scrapers which detach the magnetic constituents from the drum.

Furthermore, it is known from the prior art that suspensions comprising magnetizable components can be separated by passing this dispersion through an apparatus which in its interior has a separation space having at least one magnetizable device in the longitudinal direction and separating the magnetizable components from the nonmagnetizable components by application of an external magnetic field. This apparatus corresponds to the prior art and is described, for example, in U.S. Pat. No. 4,116,829.

These apparatuses are used primarily in processes for purifying suspensions from which magnetic components have to be removed. The purified suspension is the desired product here. In the present invention, the magnetic components are the desired product in each case.

It is an object of the present invention to provide a process by means of which at least one first material can be separated off efficiently from mixtures comprising at least one first material and at least one second material. A further object of the present invention is to treat the first particles which are to be separated off in such a way that the agglomerate of magnetic particle and first material is sufficiently stable to ensure a high yield of first material in the separation. Another object of the present invention is to provide a process of this type in which the separation of the agglomerates is efficiently ensured by suitable measures. Furthermore, a very small proportion of the at least one second material, in particular the gangue, is entrained in these steps, for example in order to increase the space-time yield of a work-up following the process of the invention.

These objects are achieved by the process of the invention for separating at least one first material from a mixture comprising this at least one first material and at least one second material, which comprises at least the following steps:

(A) contacting of the mixture comprising at least one first material and at least one second material with at least one magnetic particle in the presence of at least one dispersion medium, so that the at least one first material and the magnetic particle aggregate, (B) if appropriate, addition of further dispersion medium to the dispersion obtained in step (A), (C) separation of the agglomerate of at least one first material and at least one magnetic particle from the dispersion from step (A) or (B) in an apparatus which in its interior has a separation space having at least one magnetizable device, preferably in the longitudinal direction, by application of an external magnetic field so that the agglomerate adheres to the magnetizable device, (D) flushing and/or blowing-out of the separation space of step (C) while the external magnetic field is applied in order to be able to carry out a low-contamination change of the dispersion medium, (E) removal of the agglomerate from the magnetizable device by removal of the magnetic field and flushing with a second or modified dispersion medium in which the agglomerate is dissociated in order to obtain a dispersion which comprises the at least one first material and the at least one magnetic particle separately from one another, (F) treatment of the dispersion from step (E) in an apparatus which in its interior has a separation space having at least one magnetizable device, preferably in the longitudinal direction, by application of an external magnetic field so that the at least one magnetic particle adheres to the magnetizable devices and the at least one first material remains in dispersion, (G) flushing and/or blowing-out of the separation space of step (F) while an external magnetic field is applied in order to be able to carry out a low-contamination change of the dispersion medium, (H) removal of the at least one magnetic particle from the magnetizable device by removal of the magnetic field.

According to the invention, it is possible to use all first and second materials which are known to those skilled in the art and can be separated from one another on the basis of physical and/or chemical properties. Preference is given to the at least one first material being a hydrophobic metal compound or coal and the at least one second material being a hydrophilic metal compound.

The at least one hydrophobic metal compound, i.e. the at least one first material, is particularly preferably selected from the group consisting of sulfidic ores, oxidic ores and/or carbonate-comprising ores, for example azurite $[Cu_3(CO_3)_2(OH)_2]$ or malachite $[Cu_2[(OH)_2CO_3]]$, or the noble metals and compounds thereof.

Examples of sulfidic ores which can be used according to the invention are, for example, selected from the group of copper ores consisting of covellite CuS, molybdenum(IV) sulfide, chalcopyrite (copper pyrite) $CuFeS_2$, bornite $Cu_5FeS_4$, chalcocite (copper glance) $Cu_2S$, petlandite $(Ni, Fe)_{0.9}S$, zinc blende ZnS, galenite PbS, and also minerals of the platinum metals, for example ferroplatinum, arsenides, phosphides, tellurides, free metals and mixtures thereof. These minerals can additionally comprise valuable secondary components, for example platinum metals, silver, gold and minerals thereof, either as dopants in the crystal lattice or as crystalline inclusions.

The at least one hydrophilic metal compound, i.e. the at least one second material, is particularly preferably selected from the group consisting of oxidic and hydroxidic metal compounds, for example silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$, $Al_2O_3$, FeO(OH), $FeCO_3$ and further related minerals and mixtures thereof.

Accordingly, the process of the invention is preferably carried out using untreated ore mixtures obtained from mine deposits.

In a preferred embodiment of the process of the invention, the mixture comprising at least one first material and at least one second material is present in the form of particles having a size of from 100 nm to 100 μm in step (A), see, for example, U.S. Pat. No. 5,051,199. In a preferred embodiment, this particle size is obtained by milling. Suitable processes and apparatuses are known to those skilled in the art, for example wet milling in a ball mill.

A preferred embodiment of the process of the invention thus comprises milling the mixture comprising at least one first material and at least one second material to particles having a size of from 100 nm to 100 μm before or during step (A). Ore mixtures which can preferably be used have a content of sulfidic minerals of at least 0.01% by weight, particularly preferably at least 3% by weight.

Examples of sulfidic minerals present in the mixtures which can be used according to the invention are those mentioned above. In addition, sulfides of metals other than copper, for example sulfides of iron, lead, zinc or molybdenum, i.e. $FeS/FeS_2$, PbS, ZnS or $MoS_2$, can also be present in the mixtures. Furthermore, oxidic compounds of metals and semimetals, for example silicates or borates or other salts of metals and semimetals, for example phosphates, sulfates or oxides/hydroxides/carbonates and further salts, for example azurite $[Cu_3(CO_3)_2(OH)_2]$, malachite $[Cu_2[(OH)_2(CO_3)]]$, barite $(BaSO_4)$, monazite $((La—Lu)PO_4)$, can be present in the ore mixtures to be treated according to the invention.

An ore mixture which is typically used particularly preferably comprises the at least one first material in concentrations of from 0.001% by weight to 5% by weight, very particularly preferably from 0.001 to 2% by weight.

As magnetic particles, it is generally possible to use all magnetic particles known to those skilled in the art which satisfy the requirements of the process of the invention, for example dispersability in the dispersion medium used.

Furthermore, the magnetic particle should have a sufficiently high saturation magnetizability, for example 25-300 emu/g, and a low remanence so that the agglomerate can be separated off from the suspension in a sufficient amount in step (C) of the process of the invention.

In a preferred embodiment, the at least one magnetic particle is selected from the group consisting of magnetic metals, for example iron, cobalt, nickel and mixtures thereof, ferromagnetic alloys of magnetic metals, magnetic iron oxides, for example magnetite, maghemite, cubic ferrites of the general formula (II)

$$M^{2+}{}_xFe^{2+}{}_{1-x}Fe^{3+}{}_2O_4 \quad \text{(II)}$$

where

M is selected from among Co, Ni, Mn, Zn and mixtures thereof and $x \leqq 1$, hexagonal ferrites, for example barium or strontium ferrite $MFe_{12}O_{19}$ where M=Ca, Sr, Ba, and mixtures thereof.

In a particularly preferred embodiment of the present patent application, the at least one magnetic particle is magnetite $Fe_3O_4$ or cobalt ferrite $Co^{2+}{}_xFe^{2+}{}_{1-x}Fe^{3+}{}_2O_4$ where $x \leqq 1$, for example $Co_{0.25}Fe_{2.75}O_4$.

The size of the magnetic particles used according to the invention is preferably from 10 nm to 10 μm.

The magnetic particles used according to the invention can, if appropriate, be hydrophobicized on the surface, for example by means of at least one hydrophobic compound selected from among compounds of the general formula (III)

$$B—Y \quad (III),$$

where

B is selected from among linear or branched $C_3$-$C_{30}$-alkyl, $C_3$-$C_{30}$-heteroalkyl, optionally substituted $C_8$-$C_{30}$-aryl, optionally substituted $C_8$-$C_{30}$-heteroalkyl, $C_8$-$C_{30}$-aralkyl and Y is a group by means of which the compound of the general formula (III) binds to the at least one magnetic particle.

In a particularly preferred embodiment, B is a linear or branched $C_8$-$C_{18}$-alkyl, preferably linear $C_8$-$C_{12}$-alkyl, very particularly preferably a linear $C_{12}$-alkyl. Heteroatoms which may be present according to the invention are selected from among N, O, P, S and halogens such as F, Cl, Br and I.

In a further particularly preferred embodiment, Y is selected from the group consisting of $—(X)_n$-$SiHal_3$, $—(X)_n$-$SiHHal_2$, $—(X)_n$-$SiH_2Hal$ where Hal is F, Cl, Br, I, and anionic groups such as $—(X)_n$-$SiO_3^{3-}$, $—(X)_n$-$CO_2^-$, $—(X)_n$-$PO_3^{2-}$, $—(X)_n$-$PO_2S^{2-}$, $—(X)_n$-$POS_2^{2-}$, $—(X)_n$-$PS_3^{2-}$, $—(X)_n$-$PS_3^{2-}$, $—(X)_n$-$POS^{31}$, $—(X)_n$-$PO_2^-$, $—(X)_n$-$CO_2^{31}$, $—(X)_n$-$CS_2^-$, $—(X)_n$-$COS^-$, $—(X)_n$-C(S)NHOH, $—(X)_n$-$S^-$ where X=O, S, NH, $CH_2$ and n=0, 1 or 2, and, if appropriate, cations selected from the group consisting of hydrogen, $NR_4^+$ where the radicals R are each, independently of one another, hydrogen or $C_1$-$C_8$-alkyl, an alkali metal, an alkaline earth metal or zinc, also $—(X)_n$-$Si(OZ)_{4-n}$ where n=0, 1 or 2 and Z=charge, hydrogen or short-chain alkyl radical.

If n=2, in the formulae mentioned, two identical or different, preferably identical, groups B are bound to a group Y.

Very particularly preferred hydrophobicizing substances of the general formula (III) are alkyltrichlorosilanes (alkyl group having 6-12 carbon atoms), alkyltrimethoxysilanes (alkyl group having 6-12 carbon atoms), long-chain ($\geqq C_6$) alkylphosphonic acids, long-chain ($\geqq C_6$) monoalkylphosphoric or dialkylphosphoric esters, long-chain fatty acids (e.g. lauric acid, oleic acid, stearic acid, etc.) or mixtures thereof.

The individual steps of the process of the invention are described in detail below:

Step (A):

Step (A) of the process of the invention comprises contacting the mixture comprising at least one first material and at least one second material with at least one magnetic particle in the presence of at least one dispersion medium, so that the at least one first material and the magnetic particle agglomerate.

Suitable and preferred first and second materials are mentioned above.

In step (A) of the process of the invention, the at least one first material to be separated off and the at least one magnetic particle agglomerate. Agglomeration can in general be effected by all attractive forces known to those skilled in the art between the at least one first material and the at least one magnetic particle. According to the invention, essentially only the at least one first material and the at least one magnetic particle agglomerate in step (A) of the process of the invention, while the at least one second material and the at least one magnetic particle essentially do not agglomerate.

In a preferred embodiment of the process of the invention, the at least one first material and the at least one magnetic particle agglomerate as a result of hydrophobic interactions, different surface charges and/or compounds present in the mixture which selectively couple the at least one first material and the at least one magnetic particle.

In a particularly preferred embodiment of step (A) of the process of the invention, the at least one first material and the at least one magnetic particle agglomerate as a result of hydrophobic interactions.

The present invention therefore preferably provides the process of the invention in which the at least one first material and the magnetic particle agglomerate in step (A) as a result of hydrophobic interactions.

For the purposes of the present invention, "hydrophobic" means that the corresponding particle is intrinsically hydrophobic or can have been hydrophobicized subsequently by treatment with the at least one surface-active substance. It is also possible for an intrinsically hydrophobic particle to be additionally hydrophobicized by treatment with the at least one surface-active substance.

"Hydrophobic" means, for the purposes of the present invention, that the surface of a corresponding "hydrophobic substance" or a "hydrophobicized substance" has a contact angle of >90° with water against air. For the purposes of the present invention, "hydrophilic" means that the surface of a corresponding "hydrophilic substance" has a contact angle of <90° with water against air.

Step (A) of the process of the invention is preferably carried out using a surface-active substance of the general formula (I)

$$A—Z \quad (I)$$

which binds to the at least one first material, where

A is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl and Z is a group by means of which the compound of the general formula (I) binds to the at least one hydrophobic material.

In a particularly preferred embodiment, A is a linear or branched $C_4$-$C_{12}$-alkyl, very particularly preferably a linear $C_4$— or $C_6$-alkyl. Heteroatoms which may be present according to the invention are selected from among N, O, P, S and halogens such as F, Cl, Br and I.

In a further preferred embodiment, A is preferably a linear or branched, preferably linear, $C_6$-$C_{20}$-alkyl. Furthermore, A is preferably a branched $C_6$-$C_{14}$-alkyl in which the at least one substituent, preferably having from 1 to 6 carbon atoms, is preferably present in the 2 position, for example 2-ethylhexyl and/or 2-propylheptyl.

In a further particularly preferred embodiment, Z is selected from the group consisting of anionic groups $—(X)_n$-$PO_3^{2-}$, $—(X)_n$-$PO_2S^{2-}$, $—(X)_n$-$POS_2^{2-}$, $—(X)_n$-$PS_3^{2-}$, $—(X)_n$-$PS_2^-$, $—(X)_n$-$POS^-$, $—(X)_n$-$PO_2^-$, $—(X)_n$-$PO_3^{2-}$—$(X)_n$-$CO_2^-$, $—(X)_n$-$CS_2^-$, $—(X)_n$-$COS^-$, $—(X)_n$-C(S)NHOH, $—(X)_n$-$S^-$ where X is selected from the group consisting of O, S, NH, $CH_2$ and n=0, 1 or 2, if appropriate with cations selected from the group consisting of hydrogen, $NR_4^+$ where the radicals R are each, independently of one another, hydrogen or $C_1$-$C_8$-alkyl, an alkali metal or alkaline earth metal. The anions mentioned and the corresponding cations form, according to the invention, uncharged compounds of the general formula (I).

If n=2 in the formulae mentioned, two identical or different, preferably identical, groups A are bound to a group Z.

A particularly preferred embodiment is carried out using compounds selected from the group consisting of xanthates $A—O—CS_2^-$; dialkyl dithiophosphates $(A—O)_2$-$PS_2^-$, dialkyl dithiophosphinates $(A)_2$-$PS_2^-$ and mixtures thereof, where the radicals A are each, independently of one another, a linear or branched, preferably linear, $C_8$-$C_{20}$-alkyl, for example n-octyl, or a branched $C_8$-$C_{14}$-alkyl, with the branch preferably being present in the 2 position, for example 2-ethylhexyl and/or 2-propylheptyl. Counterions present in these compounds are preferably cations selected from the group consisting of hydrogen, $NR_4^+$ where the radicals R are each, independently of one another, hydrogen or $C_1$-$C_8$-alkyl, an alkali metal or alkaline earth metal, in particular sodium or potassium.

Very particularly preferred compounds of the general formula (I) are selected from the group consisting of sodium or potassium n-octylxanthate, sodium or potassium 2-ethylhexylxanthate, sodium or potassium 2-propylheptylxanthate, sodium or potassium butylxanthate, sodium or potassium di-n-octyldithiophosphinate, sodium or potassium di-n-amyldithiophosphate, sodium or potassium diisoamyldithiophosphate, sodium or potassium di-n-octyldithiophosphate and mixtures of these compounds.

In the case of noble metals, for example Au, Pd, Rh etc., particularly preferred surface-active substances are monothiols, dithiols and trithiols or 8-hydroxyquinolines, for example as described in EP 1200408 B1.

In the case of metal oxides, for example FeO(OH), $Fe_3O_4$, ZnO etc., carbonates, for example azurite $[Cu(CO_3)_2(OH)_2]$, malachite $[Cu_2[(OH)_2CO_3]]$, particularly preferred surface-active substances are octylphosphonic acid (OPS), $(EtO)_3Si$—A, $(MeO)_3Si$—A, with the abovementioned meanings of A. In a preferred embodiment of the process of the invention, no hydroxamates are used as surface-active substances for modifying metal oxides.

In the case of metal sulfides, for example $Cu_2S$, $MoS_2$, etc., particularly preferred surface-active substances are the abovementioned thiophosphates, thiophosphinates or xanthates.

The at least one surface-active substance is generally used in an amount which is sufficient to achieve the desired effect. In a preferred embodiment, the at least one surface-active substance is added in an amount of from 10 to 1000 g/t, in each case based on the total mixture to be treated.

Further details of this embodiment are disclosed in WO 2009/030669 A2.

The contacting in step (A) of the process of the invention can occur by all methods known to those skilled in the art. Step (A) is carried out in dispersion, preferably in suspension, particularly preferably in aqueous suspension.

Suitable dispersion media are generally all dispersion media in which the mixture in step (A) is not completely soluble. Suitable dispersion media are, for example, selected from the group consisting of water, water-soluble organic compounds, for example alcohols having from 1 to 4 carbon atoms, and mixtures thereof. In a particularly preferred embodiment, the dispersion medium is water.

The present invention therefore preferably provides the process of the invention in which the dispersion medium is water.

The amount of dispersion medium in step (A) of the process of the invention is selected so that the contacting in step (A) can be carried out and a conveyable suspension is obtained. In a preferred embodiment, the solids content of the dispersion is from 5 to 50% by weight, particularly preferably from 10 to 45% by weight, very particularly preferably from 20 to 40% by weight.

The present invention therefore preferably provides the process of the invention in which the dispersion in step (A) has a solids content of from 10 to 45% by weight.

For example, the mixture to be treated, the at least one surface-active substance and the dispersion medium are combined and mixed in the appropriate amounts. Suitable mixing apparatuses are known to those skilled in the art, for example mills such as a ball mill, tube mill, X- or T-cone or in-line mixers such as Turrax, Y- or T-mixers Step (A) of the process of the invention is generally carried out at a temperature of from 1 to 80° C., preferably from 20 to 40° C., particularly preferably ambient temperature.

Step (B):

The optional step (B) of the process of the invention comprises adding further dispersion medium to the dispersion obtained in step (A).

The mixture obtained in step (A) comprises at least one dispersion medium, agglomerates of at least one first material and at least one magnetic particle, at least one second material and, if appropriate, surface-active substances, polymeric compounds, etc., depending on which embodiment has been carried out in step (A).

Step (B) can be carried out, i.e. further dispersion medium is added, in order to obtain a dispersion having a lower concentration of solids.

Suitable dispersion media are all dispersion media which have been mentioned above in respect of step (A). In a particularly preferred embodiment, the dispersion medium is water.

In general, the amount of dispersion medium which is added in step (A) and optionally in step (B) is, according to the invention, selected so that a dispersion which is readily stirrable and/or conveyable is obtained.

In a preferred embodiment of the process of the invention, step (B) is not carried out, but step (A) is instead carried out from the beginning in an aqueous dispersion having an appropriate concentration.

The optional addition of dispersion medium in step (B) of the process of the invention can, according to the invention, be carried out by all methods known to those skilled in the art.

Step (C):

Step (C) of the process of the invention comprises separating the agglomerate of at least one first material and at least one magnetic particle from the dispersion from step (A) or (B) in an apparatus which in its interior has a separation space having at least one magnetizable device, preferably in the longitudinal direction, by application of an external magnetic field so that the agglomerate adheres magnetically to the magnetizable devices.

According to the invention, preference is given to using two or more apparatuses which in their interior have separation spaces having at least one magnetizable device in step (C) of the process of the invention. The process of the invention is preferably carried out continuously by alternate operation of these apparatuses.

Appropriate magnetizable devices are known in principle to those skilled in the art, for example wires, braids, woven meshes or metal sheets or combinations thereof. In a preferred embodiment, these magnetizable devices are installed over the entire length of the apparatus. According to the invention, it is also possible to provide sections without magnetizable devices at the beginning and/or end of the apparatus.

The magnetizable devices are preferably made of a ferromagnetic material, for example iron, so that they are magnetized by application of an external magnetic field.

The external magnetic field can be produced by devices known to those skilled in the art, for example by permanent magnets or by electromagnets. According to the invention, the expression "external magnetic field" means that the magnetic field is generated outside the separation space of the apparatus, for example by a permanent magnet or an electromagnet. The external magnetic field which is generated according to the invention has a strength of preferably from 0.2 to 1.0 tesla, particularly preferably from 0.5 to 0.8 tesla. The magnetizable device in the separation space of the apparatus locally distorts the magnetic field and produces high gradients in this magnetic field, and these gradients promote and accelerate the attachment of the magnetic components in the dispersion to the magnetizable device.

In general, the dimensions of the apparatus used in the process of the invention are selected so that efficient separation of the mixture to be treated occurs. For example, the dimensions are selected so that it is possible to separate the mixture to be treated in from 10 to 120 s, preferably from 15 to 90 s, particularly preferably from 20 to 60 s.

The flow velocity of the dispersion to be treated in the reactor is generally from 5 to 500 mm/s, preferably from 10 to 350 mm/s, particularly preferably from 15 to 250 mm/s.

Since the agglomerate of at least one first material and magnetic particle formed in step (A) of the process of the invention is magnetic, it adheres to the magnetizable device present in the interior of the apparatus as soon as a magnetic field is applied. Since the at least one second material is not magnetic, this does not adhere to the magnetizable device but is instead discharged with the dispersion which is in motion, preferably continuously. This effects the separation according to the invention.

After step (C) of the process of the invention, the agglomerate of at least one first material and at least one magnetic particle adheres to the magnetizable device in the presence of the applied magnetic field and the at least one second material is discharged with the dispersion from the reactor. Methods of disposing of this dispersion comprising at least the at least one second material are known to those skilled in the art, for example sedimentation of the solids in settling tanks and disposal of the resulting solids in a landfill.

Step (D):

Step (D) of the process of the invention comprises flushing and/or blowing-out the separation space from step (C) while the external magnetic field is applied in order to be able to carry out a low-contamination change of the dispersion medium.

in a preferred embodiment, the agglomerate adhering to the magnetizable device is, after the at least one second material has been completely separated off in step (C), washed with a dispersion medium. This is preferably carried out using the same dispersion medium which has been used in step (A), (B) and/or (C), particularly preferably water. This step enables the purity of the first material separated off later in step (F) to be increased significantly.

Further preference is given to drying the agglomerate adhering to the magnetizable device after it has been washed with a dispersion medium, in particular with water, i.e. lowering the water content of the adhering agglomerate to preferably from 1 to 25% by weight.

According to the invention, this is preferably effected by passing through air or other gaseous mixtures which are inert toward the agglomerate. Drying can also be carried out at an elevated temperature of, for example, from 40 to 80° C. and/or a pressure below atmospheric pressure, for example from 10 to 200 mbar.

The agglomerate is particularly preferably present in dried form on the magnetizable device after step (D). This helps to make it possible for step (E) to be carried out using a second dispersion medium and for this second dispersion medium to be contaminated only minimally by the first dispersion medium from steps (A) to (C).

Step (E):

Step (E) of the process of the invention comprises removing the agglomerate from the magnetizable device by removing the magnetic field and flushing with a second or modified dispersion medium in which the agglomerate is dissociated in order to obtain the at least one first material and the at least one magnetic particle separately from one another in dispersion.

Since the agglomerate of at least one first material and magnetic particle adheres to the magnetizable device as a result of magnetic interactions in the presence of a magnetic field, the adhesion of the agglomerate is lost as soon as the magnetic field is removed. In the preferred embodiment in which electromagnets are used, the removal in step (E) is effected by switching off the magnetic field. In a further embodiment in which permanent magnets are used, the removal of the magnetic field is effected by removal of the permanent magnets.

Discharge of the no longer magnetically attached agglomerate from the separation space is effected by flushing with a suitable dispersion medium. Flow velocities above 1000 mm/s can be utilized for this purpose.

In addition, dissociation of the agglomerate also occurs in step (E) of the process of the invention. In general, the dissociation of the agglomerate in step (E) can be carried out by all methods known to those skilled in the art. According to the invention, the dissociation method in step (E) depends on the method by which the agglomerate has been formed in step (A) of the process of the invention.

In the preferred embodiment of the process of the invention in which the at least one first material and the at least one magnetic particle agglomerate as a result of hydrophobic interactions in step (A) of the process of the invention, this agglomerate is preferably dissociated in step (E) by treating the agglomerate with at least one hydrophobic liquid.

The present invention therefore preferably provides the process of the invention in which the agglomerate of at least one first material and magnetic particle is treated with a hydrophobic liquid in step (E).

According to the invention, all hydrophobic liquids which form a sufficiently hydrophobic environment for the agglomerate of at least one first material and magnetic particle for bonding forces between these particles to no longer occur can be used in step (E).

Examples of suitable hydrophobic liquids are organic solvents, for example methanol, ethanol, propanol, for example n-propanol or isopropanol, aromatic solvents, for example benzene, toluene, xylenes, ethers, for example diethyl ether, methyl t-butyl ether, ketones, for example acetone, aromatic or aliphatic hydrocarbons, for example saturated hydrocarbons having, for example, from 8 to 16 carbon atoms, for example dodecane and/or Shellsol®, diesel fuels and mixtures thereof.

The main constituents of diesel fuel are predominantly alkanes, cycloalkanes and aromatic hydrocarbons having from about 9 to 22 carbon atoms per molecule and a boiling range from 170° C. to 390° C.

Particular preference is given to using diesel as hydrophobic liquid in step (E) of the process of the invention.

The present invention therefore preferably provides the process of the invention in which diesel is used as at least one hydrophobic liquid.

In a further preferred embodiment of the process of the invention, the agglomerate of at least one first material and magnetic particle is treated with at least one surfactant, particularly preferably in aqueous solution, in step (E).

The present invention therefore provides, in a particularly preferred embodiment, the process of the invention in which the agglomerate of at least one first material and magnetic particle is treated with at least one surfactant, very particularly preferably in aqueous solution, in step (E).

In this preferred embodiment, it is generally possible to use all surfactants known to those skilled in the art, for example cationic, anionic or nonionic surfactants. Particular preference is given to using nonionic surfactants in step (E) of the process of the invention. Very particular preference is given to using nonionic, linear surfactants.

In a preferred embodiment, a nonionic surfactant is used in step (E) of the process of the invention, chosen from the group of substances mentioned in the following and mixtures thereof. The at least one surfactant which is preferably used in step (E) of the process of the invention weakens or completely stops the interaction between the at least one first material and the magnetic particles, so that a separation of the agglomerates occurs in step (E).

Suitable surfactants are the following substances:

Anionic Surfactants:
Alkylbenzolsulfonates
Alpha-olefinsulfonates
Internal olefinsulfonates
Paraffine sulfonates
Alcohol sulfates
Alkylcarboxylates/soaps/fatty acids
Alkylphosphates
Alkyl- or Alkylphenolethersulfates
Alkyl- or Alkylphenolethersulfonates
Alkyl- or Alkylphenolethercarboxylates
Alkyl- or Alkylphenoletherphosphates
Alkyl- or Alkylphenoletherphosphonates
Non-Ionic Surfactants:
Alkylethoxylates
Alkylphenolethoxylates
Alkylalkoxyethoxylates (Alkoxy is for example propyleneoxide, butyleneoxide, penteneoxide, styreneoxide)
Alkypolyglucosides
fatty acid ethoxylates
Alkylaminoethoxylates
fatty acid amide ethoxylates
Alkylaminoxides
Cationic Surfactants:
Alkylamines (protonated)
Alkyletheramines (protonated)
Alkylamines quaternised (for example by dimethylsulfate or diethylsulfate)
Alkyletheramines quaternised (for example by dimethylsulfate or Diethylsulfate)
Alkylamines alkoxylated and quaternised
Alkyletheramines alkoxylated and quaternised
Betainic Surfactants:
Alkylammoniumcarboxylates
Alkylammoniumsulfonates
Alkylammoniumsulfates Suitable alkyls are long chain aliphatic linear or branched hydrocarbon radicals with $C_4$ to $C_{30}$. Further, it is possible that the aliphatic linear or branched hydrocarbon radical comprises one or more C—C double bonds.

In a particularly preferred embodiment, the at least one surfactant is used in aqueous solution in step (E). The at least one surfactant is preferably present in this aqueous solution in a concentration of from 10 ppm to 5% by weight, particularly preferably from 100 ppm to 1% by weight.

The amount of hydrophobic liquid or of the at least one surfactant, preferably the aqueous solution of the at least one surfactant, which is used according to the invention is dependent on the dimensions of the reactor used and on the amount and nature of the agglomerate.

In a particularly preferred embodiment, step (E) of the process of the invention is carried out by switching off the external magnetic field and at the same time passing a hydrophobic liquid, in particular diesel, or an aqueous solution of the at least one surfactant continuously through the separation space of the apparatus. In this particularly preferred embodiment, the hydrophobic liquid or the aqueous solution of the at least one surfactant simultaneously serves as dispersion medium.

Since a magnetic field is no longer present, the agglomerates become detached from the magnetizable devices or can be actively detached by means of a flushing step. Since sufficiently strong hydrophobic interactions are no longer present in the hydrophobic liquid or the aqueous solution of the at least one surfactant, the agglomerates are dissociated so that the at least one first material and the at least one magnetic particle are present separately from one another in dispersion. In a particularly preferred embodiment, the at least one first material and the at least one magnetic particle are present in dispersion in the hydrophobic liquid or the aqueous solution of the at least one surfactant after step (E) of the process of the invention.

Further separation methods which can be employed in step (E) are, for example, changing of the pH in the dispersion, heating or cooling of the agglomerate and the addition of additives to the dispersion medium.

Step (F):

Step (F) of the process of the invention comprises treating the dispersion from step (E) in an apparatus which in its interior has a separation space having at least one magnetizable device, preferably in the longitudinal direction, by applying an external magnetic field so that the at least one magnetic particle adheres to the magnetizable devices and the at least one first material remains in dispersion.

Step (F) of the process of the invention can generally be carried out in any appropriate apparatus which has the features according to the invention and appears suitable to a person skilled in the art for the separation of the magnetic particles from the dispersion of the at least one first material.

In a particularly preferred embodiment of the process of the invention, step (F) is carried out in the same apparatus as step (C). In a very particularly preferred embodiment of the process of the invention, at least the steps (C) to (H) are carried out in the same reactor. However, the individual steps are not carried out simultaneously but in succession.

The present invention therefore preferably provides the process of the invention in which at least the steps (C) to (H) are carried out in the same reactor.

In principle, step (F) of the process of the invention is carried out like step (C) of the process.

The dispersion from step (E) comprising the at least one first material, the at least one magnetic particle and the hydrophobic liquid is for this purpose preferably pumped through the apparatus while an external magnetic field is applied. The magnetic particles adhere to the magnetizable device located in the interior since a magnetic field is induced in this. Since the at least one first material is not magnetic, it does not adhere to the magnetizable device but remains in the dispersion and is discharged with the latter.

The parameters in respect of the reactor and the magnetic field for the separation as per step (F) are the same as in step (C) of the process of the invention.

After step (F) of the process of the invention, the at least one magnetic particle adheres, while the external magnetic field is applied, to the magnetizable device and the at least one first material is discharged from the reactor with the dispersion. As dispersion medium in step (F) of the process of the invention, preference is given to using the same hydrophobic liquid as in step (E), particularly preferably diesel.

Methods for the further use or work-up of the dispersion comprising at least the at least one first material are known to those skilled in the art, for example filtration, centrifugation, decantation with subsequent smelting of the first material which has been separated off.

Step (G):

Step (G) of the process of the invention comprises flushing and/or blowing-out of the separation space from step (F) while the external magnetic field is applied in order to be able to carry out a low-contamination change of the dispersion medium.

In a preferred embodiment, the magnetic particles adhering to the magnetizable device are, after all of the at least one first material has been separated off, washed with a dispersion medium in step (G) in order to remove, for example, any remaining at least one first material from the magnetic particles. This is preferably carried out using the hydrophobic liquid used in step (E) and (F), particularly preferably diesel.

The magnetic particles adhering to the magnetizable device are, after washing with a hydrophobic liquid, preferably also dried, preferably until the hydrophobic liquid has been removed essentially completely from the magnetic particles. The drying after step (G) of the process of the invention is, according to the invention, preferably carried out by passing through air or other gaseous mixtures which are inert toward the magnetic particles. Drying is preferably carried out in a manner analogous to the optional drying step mentioned in respect of step (D). The external magnet is active in this case and holds the magnetic particles firmly on the magnetizable device.

The present invention therefore preferably provides the process of the invention in which the residues adhering to the magnetizable device after step (D) and/or (G) are dried.

The magnetic particles are particularly preferably present in dried form on the magnetizable device after step (G). The residual moisture contents which can be achieved are preferably in the range from 15 to 35% by weight.

Step (H):

Step (H) of the process of the invention comprises removing the at least one magnetic particle from the magnetizable device by removing the magnetic field.

Step (H) of the process of the invention is preferably carried out as described in respect of step (E).

In a particularly preferred embodiment, the magnetic particles are treated with a suitable dispersion medium with the external magnetic field switched off in step (H) of the process of the invention. Suitable dispersion media are those mentioned above in respect of step (A), particularly preferably water.

After step (H) of the process of the invention, a dispersion of the magnetic particles in a dispersion medium, in particular in water, is preferably obtained.

The magnetic particles can be separated from the dispersion medium by known methods, for example drying at elevated temperature and/or under reduced pressure.

In a preferred embodiment of the process of the invention, the magnetic particles obtained in step (H) of the process of the invention are, if appropriate after work-up, recirculated to step (A).

The present invention therefore preferably provides the process of the invention in which the magnetic particles obtained in step (H) are recirculated to step (A).

EXAMPLES

Example 1

800 g Tailings from a palladium-mine are stirred with a solution of 0.24 g potassium-di-n-octyldithiophosphate in 800 mL of water in a stirrer reactor having a Teflon-coated anchor agitator. (r=12 cm) at 500 rpm for 30 min. Subsequently, 35 g hydrophobised magnetite ($d_{50}$=4 μm) are added and are mixed for further 30 min. Subsequently, this pulp is diluted to a solid content of 20% and is separated magnetically in a magnetic separator. The magnetic fraction (51 g) is stirred vigorously for 20 min. in 1 L of a 0.1% by weight solution of an ethoxylated aliphatic $C_{12}$-$C_{14}$ alcohol (non-ionic surfactant) and is subsequently separated magnetically. The magnetic fraction obtained therefrom is washed with 1 L of fresh water to free the hydrophobised magnetite from surfactant. The unmagnetic fraction of the 2. separation comprises 40% of noble metals which have originally been present in tailings having a grade of 180 g/t.

The invention claimed is:

1. A process for separating at least one first material from a mixture comprising this at least one first material and at least one second material, which comprises at least the following steps:

(A) contacting of the mixture comprising at least one first material and at least one second material with at least one magnetic particle in the presence of at least one dispersion medium, so that the at least one first material and the magnetic particle aggregate, (B) if appropriate, addition of further dispersion medium to the dispersion obtained in step (A), (C) separation of the agglomerate of at least one first material and at least one magnetic particle from the dispersion from step (A) or (B) in an apparatus which in its interior has a separation space having at least one magnetizable device, preferably in the longitudinal direction, by application of an external magnetic field so that the agglomerate adheres to the magnetizable device, (D) flushing and/or blowing-out of the separation space of step (C) while the external magnetic field is applied in order to be able to carry out a low-contamination change of the dispersion medium, (E) removal of the agglomerate from the magnetizable device by removal of the magnetic field and flushing with a second or modified dispersion medium in which the agglomerate is dissociated in order to obtain a dispersion which comprises the at least one first material and the at least one magnetic particle separately from one another, (F) treatment of the dispersion from step (E) in an apparatus which in its interior has a separation space having at least one magnetizable device, preferably in the longitudinal direction, by application of an external magnetic field so that the at least one magnetic particle adheres to the magnetizable devices and the at least one first material remains in dispersion, (G) flushing and/or blowing-out of the separation space of step (F) while an external magnetic field is applied in order to be able to carry out a low-contamination change of the dispersion medium, (H) removal of the at least one magnetic particle from the magnetizable device by removal of the magnetic field.

2. The process according to claim 1, wherein at least the steps (C) to (H) are carried out in the same reactor.

3. The process according to claim 1, wherein the at least one first material is a hydrophobic metal compound or coal and the at least one second material is a hydrophilic metal compound.

4. The process according to claim 3, wherein the at least one hydrophobic metal compound is selected from the group consisting of sulfidic ores, oxidic ores and carbonate-comprising ores.

5. The process according to claim 3, wherein the at least one hydrophilic metal compound is selected from the group consisting of oxidic and hydroxidic metal compounds.

6. The process according to claim 1, wherein the at least one first material and the magnetic particle agglomerate in step (A) as a result of hydrophobic interactions.

7. The process according to claim 1, wherein the agglomerate of at least one first material and magnetic particle is treated with a hydrophobic liquid in step (E).

8. The process according to claim 7, wherein the at least one hydrophobic liquid is diesel.

9. The process according to claim 1, wherein the agglomerate of at least one first material and magnetic particle is treated with at least one surfactant in step (E).

10. The process according to claim 1, wherein the magnetic particles obtained in step (H) are recirculated to step (A).

11. The process according to claim 1, wherein the dispersion in step (A) has a solids content of from 10 to 45% by weight.

12. The process according to claim 1, wherein the residues adhering to the magnetizable device in step (D) and/or (G) are dried.

* * * * *